US010117471B2

(12) United States Patent
Nam

(10) Patent No.: US 10,117,471 B2
(45) Date of Patent: Nov. 6, 2018

(54) MULTIPURPOSE GARMENT

(71) Applicant: Kiyeon Nam, Bayside, NY (US)

(72) Inventor: Kiyeon Nam, Bayside, NY (US)

( * ) Notice: Subject to any disclaimer, the term of this patent is extended or adjusted under 35 U.S.C. 154(b) by 0 days.

(21) Appl. No.: 15/213,888

(22) Filed: Jul. 19, 2016

(65) Prior Publication Data

US 2018/0020750 A1 Jan. 25, 2018

(51) Int. Cl.

| | |
|---|---|
| ***A41D 15/00*** | (2006.01) |
| ***A41D 27/10*** | (2006.01) |
| ***A41D 27/08*** | (2006.01) |
| ***A41D 19/01*** | (2006.01) |
| ***D04B 15/36*** | (2006.01) |
| ***D04B 15/10*** | (2006.01) |
| ***D04B 7/34*** | (2006.01) |
| ***D04B 7/28*** | (2006.01) |
| ***A41D 23/00*** | (2006.01) |
| ***A41D 3/08*** | (2006.01) |
| ***A41D 27/24*** | (2006.01) |
| ***A41D 15/04*** | (2006.01) |
| *D04B 1/24* | (2006.01) |

(52) U.S. Cl.

CPC ..... *A41D 15/00* (2013.01); *A41D 3/08* (2013.01); *A41D 15/04* (2013.01); *A41D 19/01* (2013.01); *A41D 23/00* (2013.01); *A41D 27/08* (2013.01); *A41D 27/10* (2013.01); *A41D 27/24* (2013.01); *D04B 7/28* (2013.01); *D04B 7/34* (2013.01); *D04B 15/10* (2013.01); *D04B 15/36* (2013.01); *A41D 2500/10* (2013.01); *D04B 1/24* (2013.01)

(58) Field of Classification Search

CPC ..... A41D 15/04; A41D 3/08; A41D 11/00; A41D 15/00; A41D 3/00; A41D 7/008; A41D 27/10; A41D 1/205; A41D 23/00; A41D 7/006; A41D 13/00; A41D 13/08; A47G 9/064; A47G 9/0223; A47G 9/066; A47G 9/0207; A47G 9/068; A47G 9/086; A47G 9/1045; A47G 9/06; A45F 4/12; A45F 4/02; A47D 15/006; A47D 15/008; A47D 15/02

See application file for complete search history.

(56) References Cited

U.S. PATENT DOCUMENTS

| | | | | | |
|---|---|---|---|---|---|
| 2,024,044 | A | * | 12/1935 | Johnson | A41D 15/04 2/88 |
| 2,140,797 | A | * | 12/1938 | Hammerman | A41B 13/06 128/873 |
| 2,676,319 | A | * | 4/1954 | Davidson | G21F 3/02 2/1 |
| 2,727,240 | A | * | 12/1955 | Marshall | A41D 13/04 2/50 |
| 4,316,288 | A | * | 2/1982 | Henrickson | A41D 15/00 2/84 |

(Continued)

*Primary Examiner* — Bobby Muromoto, Jr.

(74) *Attorney, Agent, or Firm* — Feldman Law Group, P.C.; Steven M. Crosby

(57) ABSTRACT

A multipurpose garment has an elongate body portion formed from one or more pieces of material that is generally rectangular in shape defined by top and bottom vertical edge portions and top and bottom horizontal edge portions, and left and right sleeve portions. In embodiments, the multipurpose garment is manufactured using a flatbed knitting machine employing a knit-in technique such that there is no visible seem between the body portion and the sleeves.

8 Claims, 12 Drawing Sheets

(56) References Cited

U.S. PATENT DOCUMENTS 5,131,096 A * 7/1992 Olson ..... A41D 11/00 2/69
5,245,717 A * 9/1993 Rudy ..... A47B 23/007 2/69
5,611,095 A * 3/1997 Schneider ..... A41B 13/06 2/69
5,875,492 A * 3/1999 Moss ..... A41D 3/08 2/82
5,901,375 A * 5/1999 Davis ..... A41D 15/04 2/69
D417,767 S * 12/1999 Newhaller ..... D2/860
6,006,356 A * 12/1999 Song ..... A41D 1/00 2/102
6,349,411 B1 * 2/2002 Tyler ..... A41D 3/08 2/69
6,408,439 B1 * 6/2002 Garforth-Crippen ..... A41B 13/00 2/80
6,708,343 B1 * 3/2004 Ceron ..... A41D 3/08 2/84
6,735,781 B1 * 5/2004 Fulmer ..... A41D 15/04 2/94
6,859,942 B1 * 3/2005 Cratty ..... A41D 3/08 2/88
7,065,810 B2 * 6/2006 Robinson ..... A47D 15/02 5/494
7,222,371 B2 * 5/2007 Houghton ..... A41D 23/00 2/69
7,587,769 B1 * 9/2009 McDermott ..... A41B 13/06 2/69
8,225,422 B1 * 7/2012 McSparron ..... A41B 13/005 2/67
8,276,212 B2 * 10/2012 Quintanilla ..... A41B 13/06 2/48
9,155,341 B2 * 10/2015 Czarnik ..... A41D 15/04
9,775,387 B2 * 10/2017 Parr ..... A41D 3/00
9,775,388 B2 * 10/2017 Czarnik ..... A41D 3/08
2002/0129445 A1 * 9/2002 Deering ..... A47G 9/066 5/482
2003/0079270 A1 * 5/2003 Bailey ..... A41B 13/06 2/69.5
2004/0019969 A1 * 2/2004 Gatten ..... A41B 13/06 5/482
2005/0039241 A1 * 2/2005 Khan ..... A41D 13/00 2/86
2005/0115281 A1 * 6/2005 Mitchell ..... A41B 9/06 66/176
2006/0064795 A1 * 3/2006 Houghton ..... A41D 23/00 2/88
2008/0028518 A1 * 2/2008 Miotke ..... A47G 9/06 5/482
2008/0115254 A1 * 5/2008 Galkov ..... A41D 3/00 2/108
2008/0172788 A1 * 7/2008 Rosen ..... A47G 9/064 5/417
2008/0209609 A1 * 9/2008 Panek ..... A41D 3/08 2/66
2009/0165206 A1 * 7/2009 Davis ..... A47D 15/006 5/494
2009/0229031 A1 * 9/2009 Jackson ..... A41B 13/06 2/69
2010/0017929 A1 * 1/2010 Kenney ..... A41D 13/04 2/49.1
2010/0059558 A1 * 3/2010 Robinson ..... A41D 3/08 224/155
2010/0170039 A1 * 7/2010 Davis ..... A47D 15/006 5/494
2010/0186166 A1 * 7/2010 Sulentic ..... A41D 13/08 5/494
2010/0205714 A1 * 8/2010 Pollack ..... A47G 9/066 2/69
2012/0005801 A1 * 1/2012 Parr ..... A41D 3/08 2/84
2012/0276802 A1 * 11/2012 Anderman ..... A63H 3/003 446/27
2013/0239290 A1 * 9/2013 Rossi ..... A41D 7/008 2/84
2014/0020177 A1 * 1/2014 Coates ..... A41B 13/06 5/494
2014/0157480 A1 * 6/2014 Czarnik ..... A41D 15/04 2/69
2014/0165254 A1 * 6/2014 Bowen ..... A41D 7/008 2/69
2014/0352063 A1 * 12/2014 Mitchell ..... A47G 9/0223 5/494

* cited by examiner

400

MULTIPURPOSE GARMENT

BACKGROUND

Shawls are often worn to keep the wearer warm, impart a feeling of comfort and coziness, and even to impart a sense of style. A traditional shawl may range from a simple decorative rectangular segment of knit or woven fabric to more elaborate knit patterns that offer greater warmth. Where some shawls may simply be a utilitarian garment made form cotton, wool, acrylic or the like, for use in, e.g., a healthcare facility, others may be super-luxury Whatever the style, the shawl is typically wrapped around the shoulders of the wearer and allowed to drape, with the wearer relying on the dual forces of gravity and friction to keep the garment in position.

These traditional shawls have significant drawbacks. Because the garment is held in place only by gravity and friction, it is susceptible to slipping out of position or off the wearer entirely. A wearer that is in motion or otherwise active may need to hold the garment in place with one hand, reducing the wearer's ability to engage in other activity while wearing the garment. Similarly, since the shawl typically drapes, the front hangs open. In order to take advantage of the garment's heat-retention properties, the wearer must manually hold the garment closed around the front. The wearer may also wish to keep the shawl closed for stylistic reasons as well, which would likewise immobilize one hand. Because of its amorphous shape, a shawl may be utilized as a scarf, neckerchief or similar accessory, particularly when made from a thin material such as silk or satin.

A related garment to the shawl is the drape-front cardigan, which is traditionally a loose-fitting open-front sweater with integrated sleeves. FIG. 1 shows one such cardigan.

These cardigans may be made from the same materials and yarns as shawls, ranging from cotton and wool yarns to more elegant silks and sateen fabrics. Drape-front cardigans such as that shown in FIG. 1 can present a more elegant appearance than a traditional shawl and have the additional benefit of hanging securely on the wearer. Unlike the sleeveless shawl, the drape-front cardigan may include sleeves that provide additional stability and security on the wearer. The wearer is thus able to use both hands providing for a more versatile experience.

However, many drape-front cardigans suffer from significant drawbacks. As with a shawl, the drape-front cardigan may simply hang open, reducing the heat-retention properties of the garment and perhaps diminishing its stylishness. The drape-front cardigan is worn like a sweater so the wearer must insert the arms into the sleeves to put it on, an additional step not present with a traditional shawl. Further, the drape-front cardigan may lack versatility and cannot be adapted to other uses.

Combinations have been proposed in which sleeves are integrated into a traditional shawl. Referring to FIG. 2, one such garment in shown in which two separate sleeve portions are knit and then linked on to the main body portion of the garment. However, these proposals still suffer from significant drawbacks.

Where sleeve portions are simply formed and attached, the user cannot wear the garment as a shawl since the presence of the sleeve portions interferes with the draping of the shawl on the wearer. The sleeves also inhibit fashioning the garment into an accessory.

Further, sleeves that are formed and attached to a shawl require additional labor to fabricate the sleeve and then attached it to the main portion of the garment. Additional labor can introduce additional cost to the product.

Commercially-available knitting processes have generally been limited and are unable to produce an integrated shawl-like garment in which components such as armholes are integrated into a single seamless garment produced in a single step.

What is needed is a versatile multi-purpose article that can fill the combined functions of sweater and shawl, and that can be efficiently manufactured.

What is further needed is a multi-purpose article that can still fill the function of sweater or shawl individually.

What is further needed is a combined sweater and shawl that presents a clean, stylish appearance.

BRIEF DESCRIPTION OF THE DRAWINGS

The features and advantages of the present disclosure will be more fully understood with reference to the following detailed description when taken in conjunction with the accompanying figures, wherein.

The features and advantages of the present disclosure will be more fully understood with reference to the following detailed description when taken in conjunction with the accompanying figures, wherein.

SUMMARY

In some embodiments, a multimodal garment may include a body portion, a left sleeve portion formed in the elongate body portion substantially parallel to the first and second horizontal edge portions, and/or a right sleeve portion formed in the elongate body portion substantially parallel to the first and second horizontal edge portions. In some embodiments, the body portion may include first and second horizontal edge portions, and first and second vertical edge portions.

In some embodiments, the left and right sleeve portions are configured as tubes extending outward from adjacent a center vertical axis of the body portion outward to the vertical edge of the body portion without a visible seam.

In some embodiments, the body portion, left sleeve portion, and right sleeve portion are formed together using a tubular knitting technique. In some embodiments, the left and right sleeve portions are configured as sewn-on tubes extending outward from adjacent a center vertical axis of the body portion outward to the vertical edge of the body portion with visible seams. In some embodiments, the body portion, left sleeve portion, and right sleeve portion are formed together using a whole garment seamless knitting technique.

In some embodiments, a multimodal garment may include a body portion and/or a secondary torso panel formed in the elongate body portion, and integrated into the body portion on at least two sides.

In some embodiments, each of the left and right sleeve portions are closed at at least one end. In some embodiments, each of the left and right sleeve portions terminate in an integrated mitten or glove portion.

In some embodiments, the garment is formed from one of natural fibers such as wool, cotton, linen, silk and synthetic fibers such as rayon, nylon and polyester and any of the blend.

In some embodiments, such a multimodal garment may further include a decorative adornment, including fringe, jacquard, intarsia, cable knitting, or pointelle textured stitches.

In some embodiments, a multimodal garment may include a substantially planar body portion body portion and/or a left sleeve portion and a right sleeve portion formed in the planar body portion. In some embodiments, the substantially planar body portion body portion may include at least one edge. In some embodiments, the left and right sleeve portions are configured as tubes extending outward from adjacent a center vertical axis of the planar body portion outward to an edge of the body portion. In some embodiments, the left and right sleeve portions are integrally formed with the planar body portion in a single process using a tubular knitting technique.

DETAILED DESCRIPTION

In embodiments a multimodal garment is described in which sleeve portions are integrated into the body using a tubular knitting-in technique. Embodiments of the invention may be sold under the trademark SHUGG™.

Figure 1:
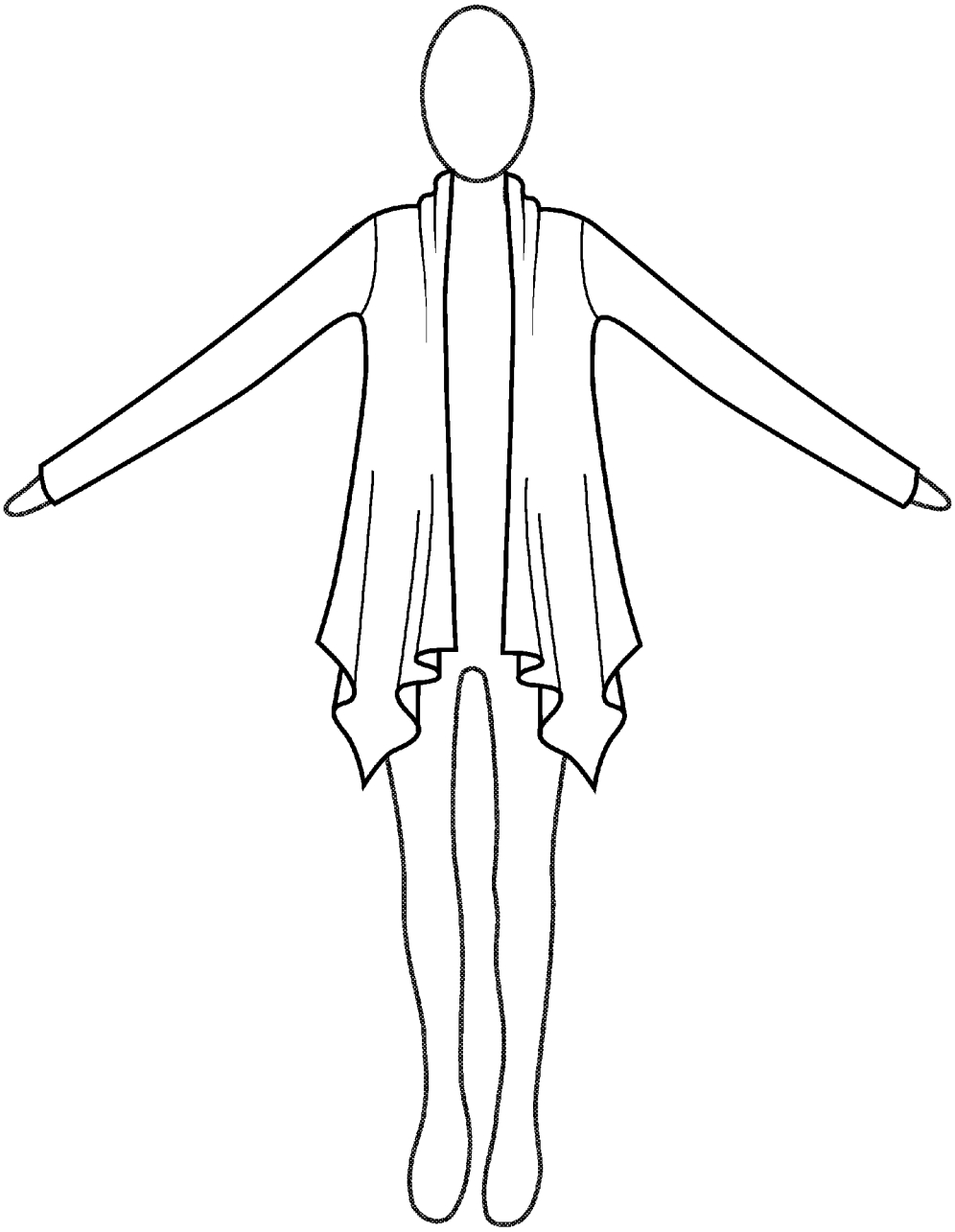
FIG. 1 (PRIOR ART)
FIG. 1 shows a prior art design for drape-front cardigan.
Figure 2:
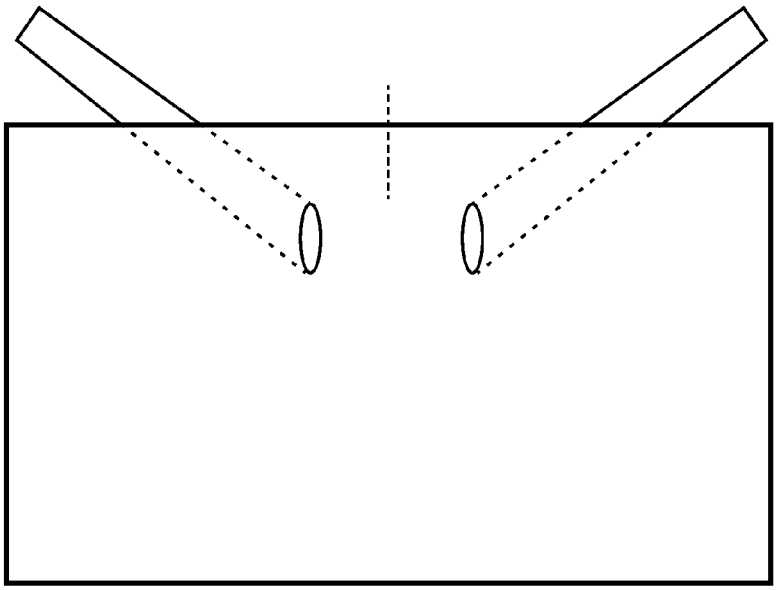
FIG.2 (PRIOR ART)
FIG. 2 shows a prior art design for drape-front cardigan in a flattened configuration.
Figure 3:
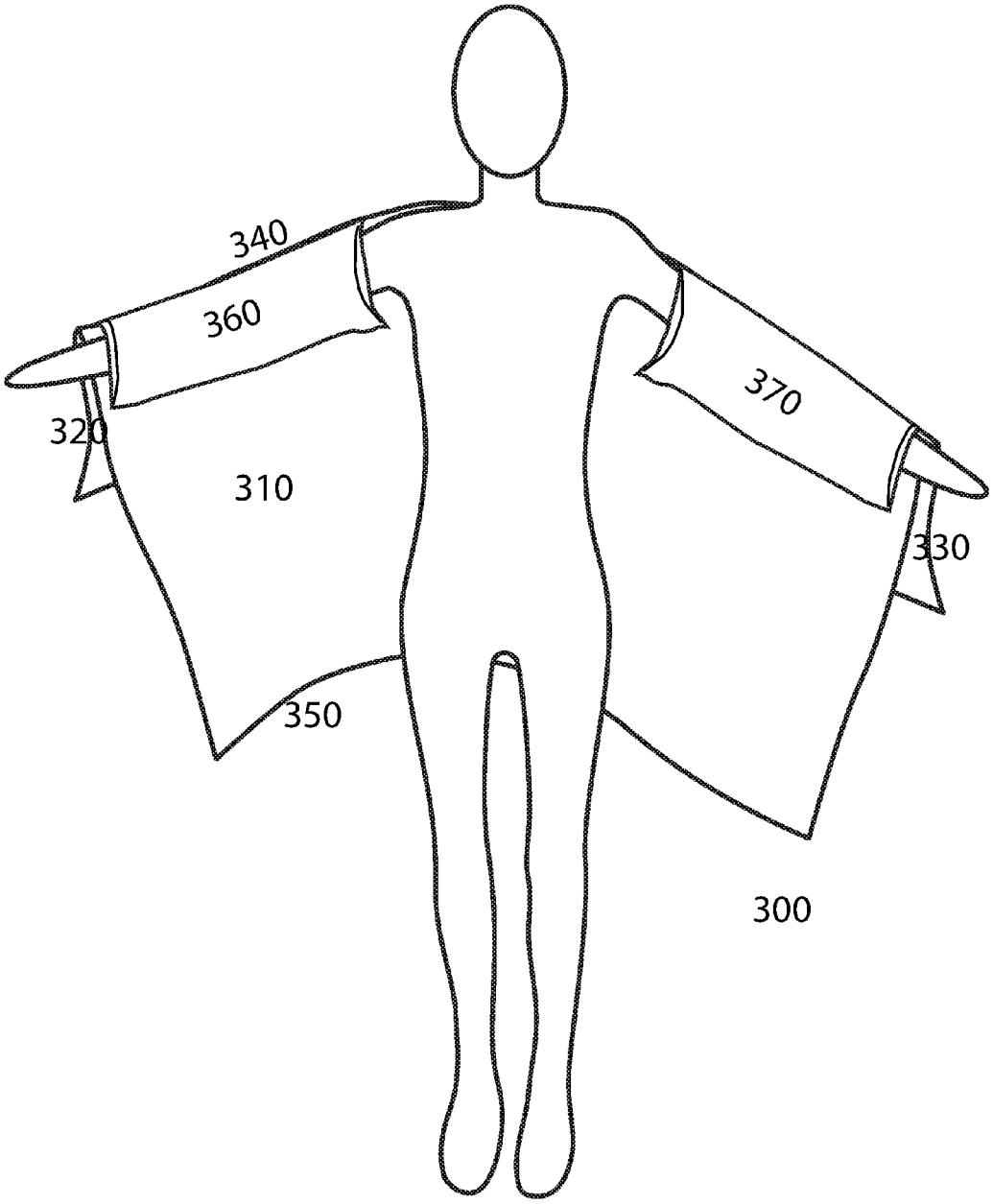
FIG. 3 shows a multipurpose garment according to embodiments of the invention.

Referring to FIG. 3, an exemplary garment is shown in a position of use. Garment 300 may comprise an elongate body portion 310 formed from one or more pieces of material that is generally rectangular in shape defined by right and left vertical edge portions 320, 330 and top and bottom horizontal edge portions 340 and 350. In alternate embodiments, shapes beyond rectangular may be utilized such as circular and polygonal.

It will be appreciated by those of skill in the art that a wide variety of sizes and shapes may be used for elongate body portion 310. In a preferred embodiment, a rectangular body portion is contemplated, of a length sufficient to cover the wearer and appropriate to the desired style. It should be noted that in differing embodiments, the rectangular-shaped elongate body portion may be oriented such that the longer edges are aligned with the horizontal plane, or alternatively, that the longer edges are aligned with the vertical plane. In embodiment other shapes may be used depending on the application including, polygonal, circular, oval, and elliptical, among others.

In embodiments, sleeve portions 360 and 370 may be formed in the garment. A left sleeve portion 370 may be defined along a segment of top horizontal edge portion 340, and a corresponding right sleeve portion 360 may be defined along a segment of top horizontal edge portion 340. In embodiments, left and right sleeve portions 360, 370 may take the form of mirror opposites of each other. In embodiments, left and right sleeve portions 360, 370 are designed to accommodate the left and right arms of the wearer, respectively, and extend to a length that may vary with the size of the garment (e.g., S, M, L, XL) or be based upon the average size of a wearer. The left and right sleeve portions 360, 370 may be open-ended to allow the hands of the wearer to protrude. In alternate embodiments, left and right sleeve portions 360, 370 may be closed-ended and capped with an integrated mitten or glove for additional warmth.

A wide variety of materials may be utilized in garment 300, both in the body portion 310 and sleeve portions 360, 370. In a preferred embodiment, a wool sweater knit may be used. In alternate embodiments fabrics such as cotton, linen, silk or other woven fabrics may be utilized.

As shown in FIG. 3, in use, the arms of the wearer may be inserted through left and right sleeve portions 360, 370 and the garment then may drape.

Additional stylistic elements may be incorporated into garment 300. For example, decorative adornments such as fringe at right and left vertical edge portions 320, 330 may be incorporated into body portion 310. Additional examples of textures for both in the body portion 310 and sleeve portions 360, 370 may include jacquard, cable or pointelle textured stitches.

Figure 4:
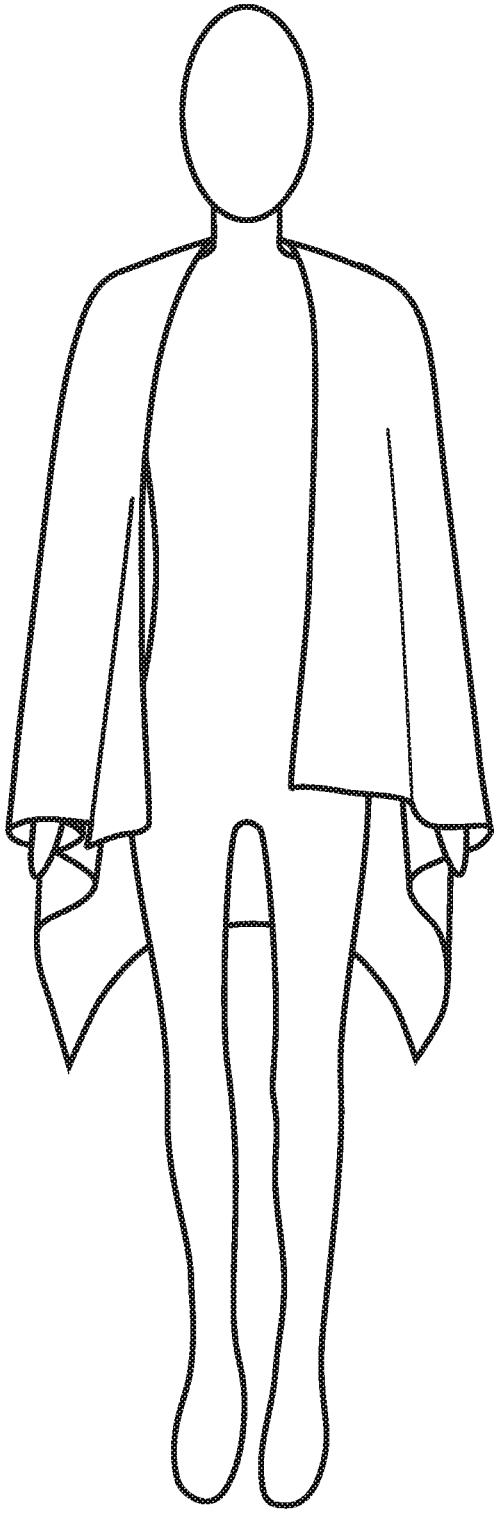
FIG. 4 shows a front view of a multipurpose garment according to embodiments of the invention, in a different configuration.

FIGS. 4-9 show an embodiment of the invention in various stages and configurations of use. FIG. 4 shows an embodiment 400 in a shawl configuration, with the wearer's arms inserted through the sleeve portions and the garment wrapped tightly around the shoulders of the wearer. The garment in this configuration is secured by the wearer's arms, minimizing or eliminating instances of the garment falling off the body of the wearer. Since the wearer is not utilizing their hands to secure the garment, the hands are free for other purposes.

Figure 5:
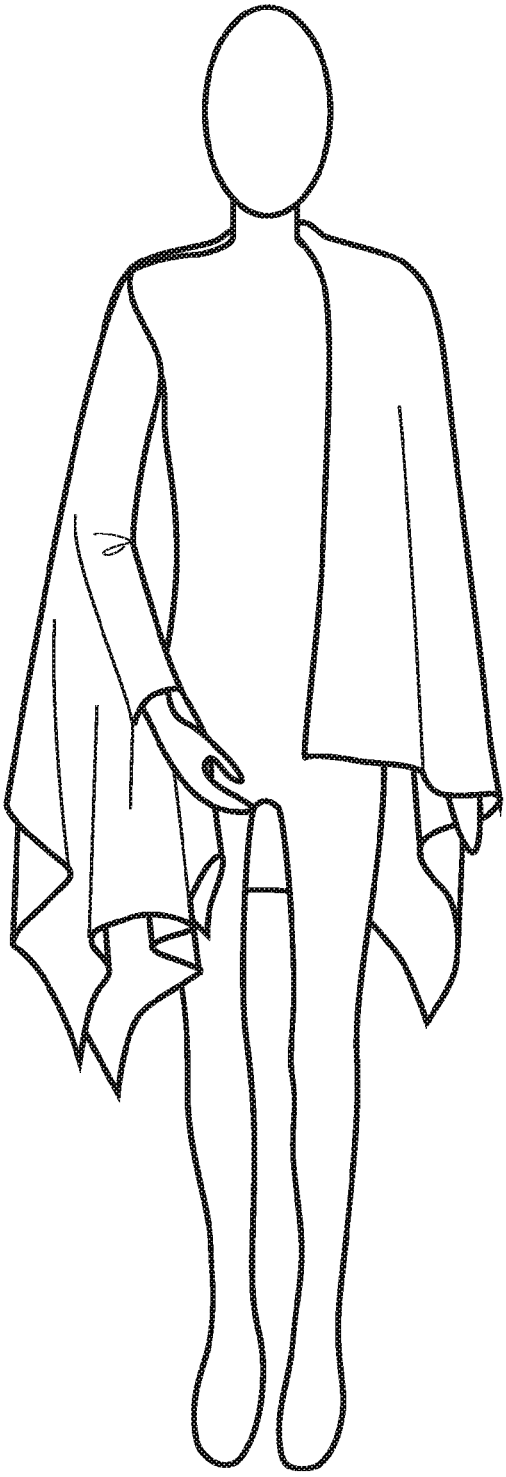
FIG. 5 shows a front view of a multipurpose garment according to embodiments of the invention, in a different configuration.
Figure 6:
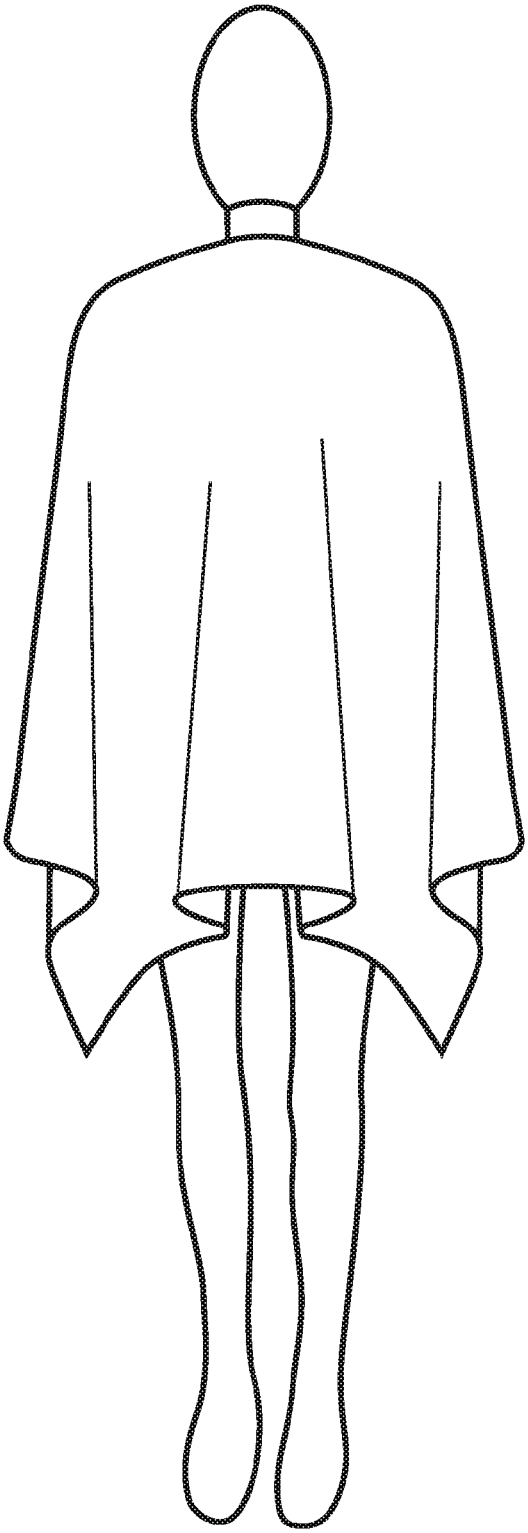
FIG. 6 shows a rear view of a multipurpose garment according to embodiments of the invention, in a different configuration.

FIGS. 5-6 show front and rear views of an embodiment in a multi-purpose garment configuration with an open front. The garment is slowed to drape more freely than what is shown in FIG. 4, while remaining secure on the wearer's body with the hands free.

Figure 7:
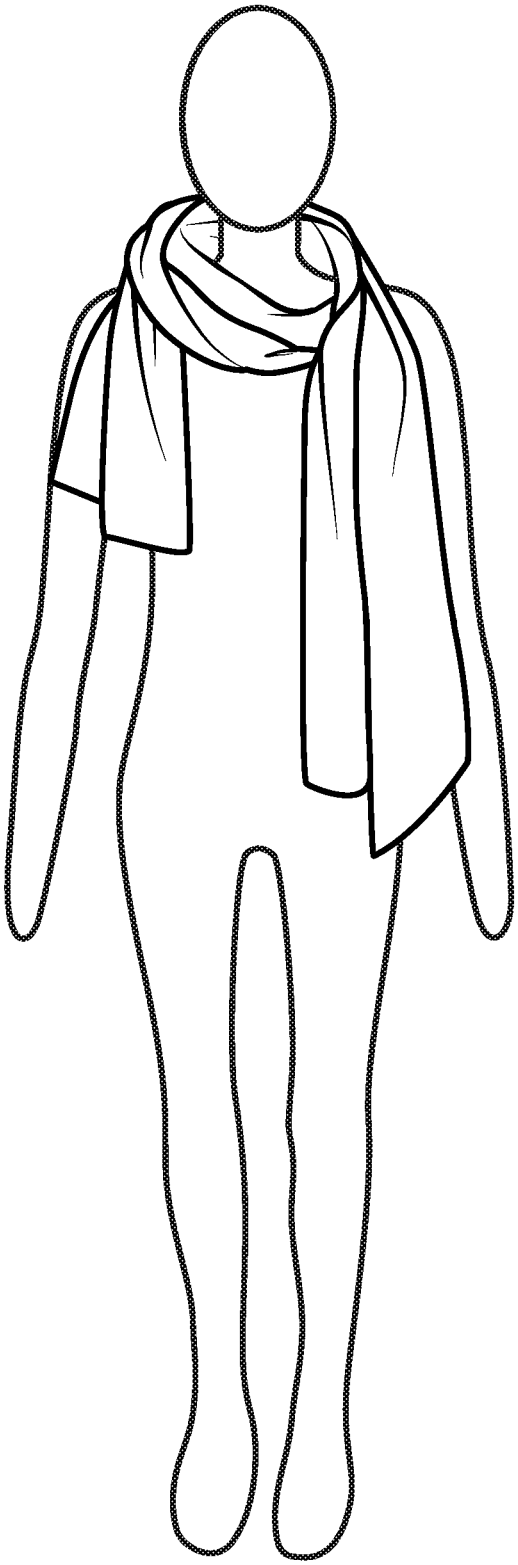
FIG. 7 shows a front view of a multipurpose garment according to embodiments of the invention, in a different configuration.

FIG. 7 shows a further embodiment of the invention in which the garment takes the form of a scarf. Because of the integrated left and right sleeve portions formed with the garment, there are no loose-hanging sleeve portions that would interfere with the scarf configuration, either mechanically or visually.

Figure 8:
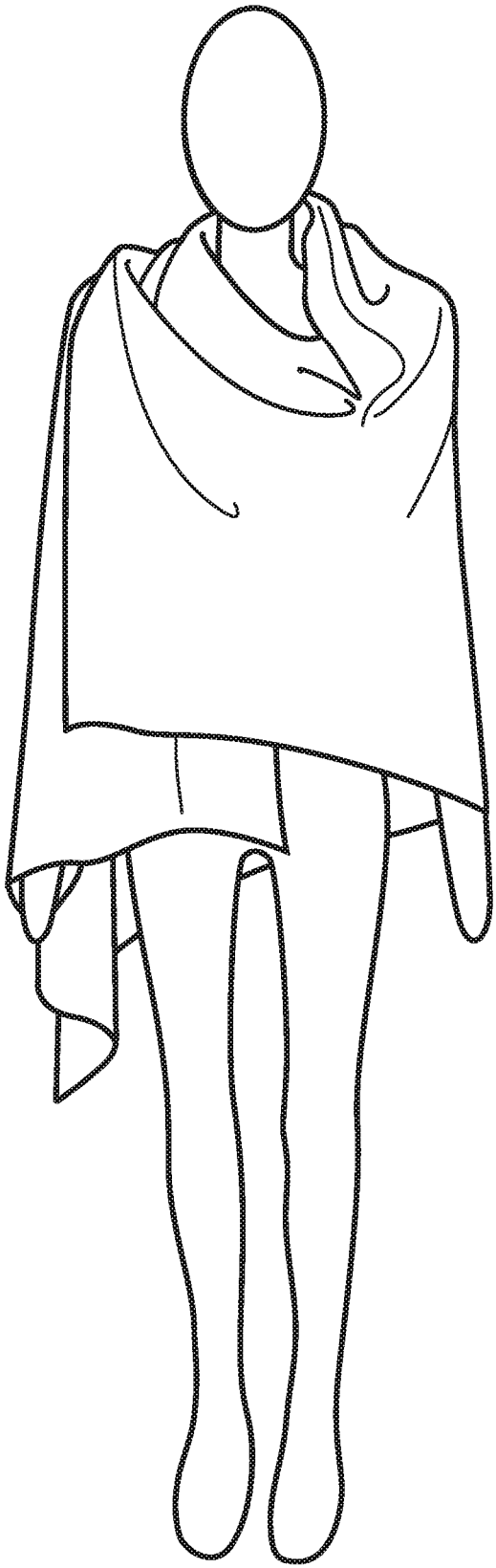
FIG. 8 shows a front view of a multipurpose garment according to embodiments of the invention, in a different configuration.

Lastly, FIG. 8 shows an embodiment in which the garment is worn as a shawl with one side arm inserted into a sleeve portion and wrapped around the other side to create an asymmetrical configuration. In a preferred embodiment, the garment of FIG. 3, can be utilized in each of these configurations, providing a varied experience for the wearer without requiring distinct garments.

Figure 9:
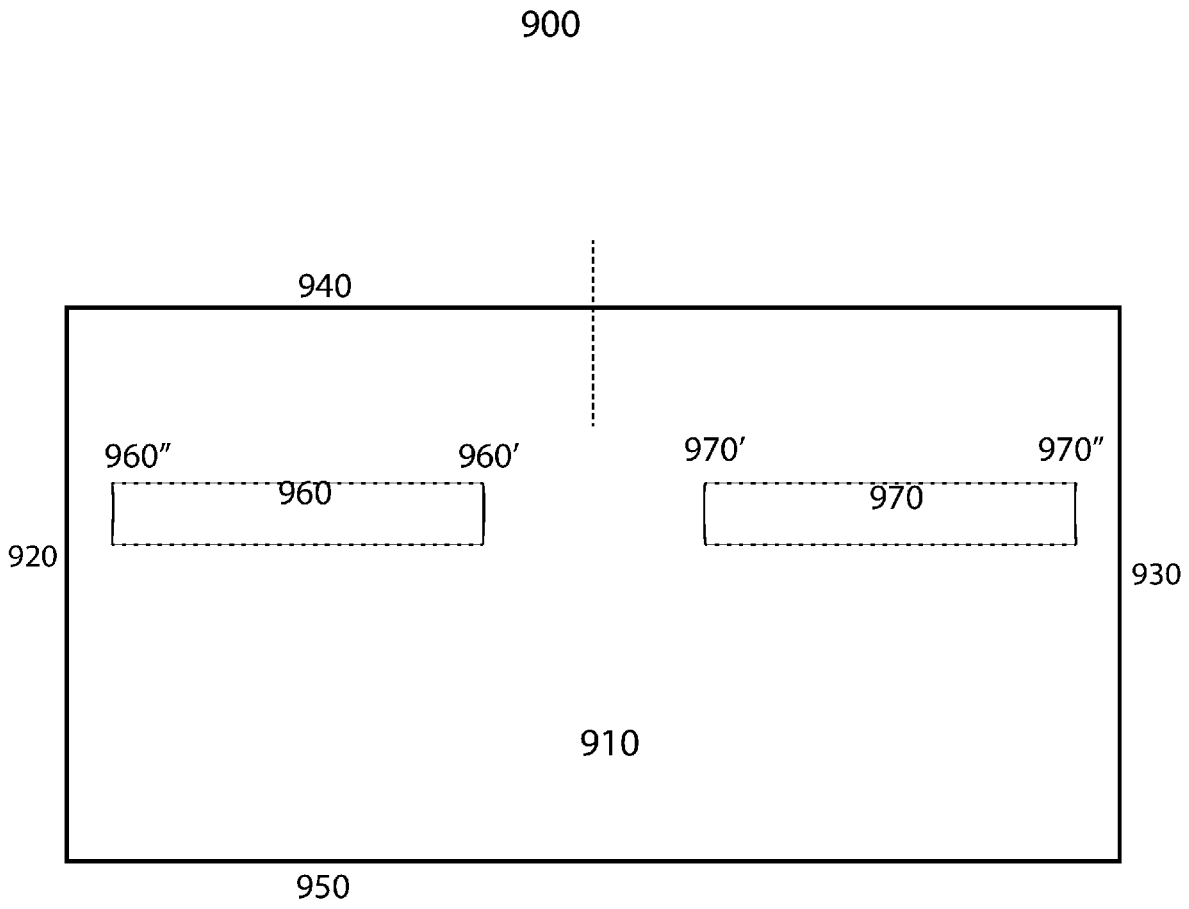
FIG. 9 shows a multipurpose garment in a flattened configuration, according to embodiments of the invention.

Referring to FIG. 9, garment 900 of FIG. 3 is shown laid flat. As with the view shown in FIG. 3, FIG. 9 comprises an elongate body portion 910. Body portion 910 may be formed from one or more pieces of material that is generally rectangular in shape defined by top and bottom vertical edge portions 920, 930 and top and bottom horizontal edge portions 940, 950.

Sleeve portions 960, 970 may be formed in the garment and defined as a tubular knit portion fabricated according to the process described below. Each sleeve portion has an opening 960', 970' that is proximal to the wearer. A corresponding opening 960", 970" is formed opposite the corresponding opening 960', 970' to form a tube through which the arms of the wearer may be inserted.

In embodiments, left and right sleeve portions 960, 970 may be formed with garment 900 during manufacturing using a tubular knit-in technique that enables three-dimensional knitting of the complete garment including, for example, tubular knitting to form 960, 970 in the same process as with the main body portion.

Alternatively, sleeve portions 960, 970 may be laterally linked-on by linking machine or sewn-on by sewing machine leaving openings 960', 970' and corresponding opening 960", 970".

Various alternate embodiments of the invention are contemplated to fulfill various stylistic or manufacturing requirements.

Figure 10:
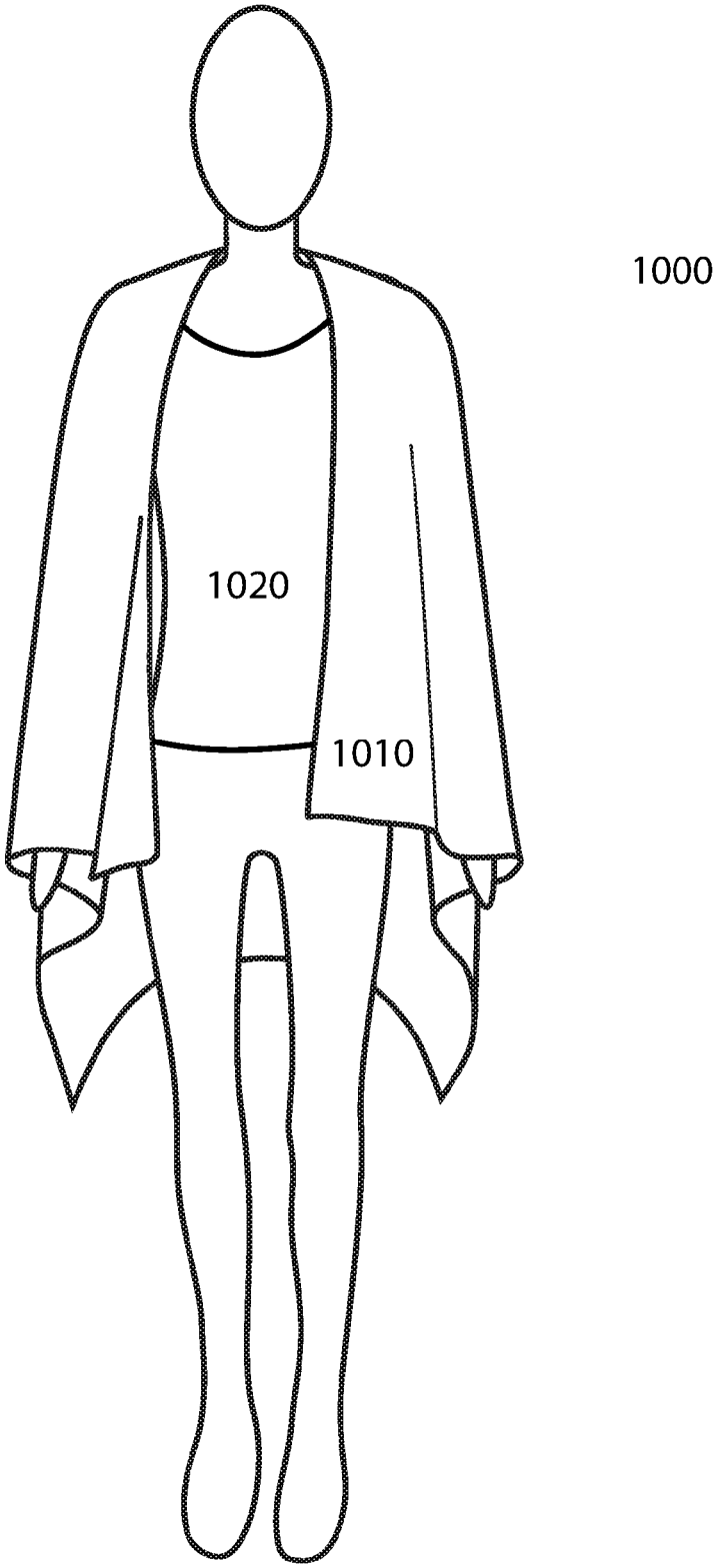
FIG. 10 shows an alternate embodiment of the present invention.
Figure 11:
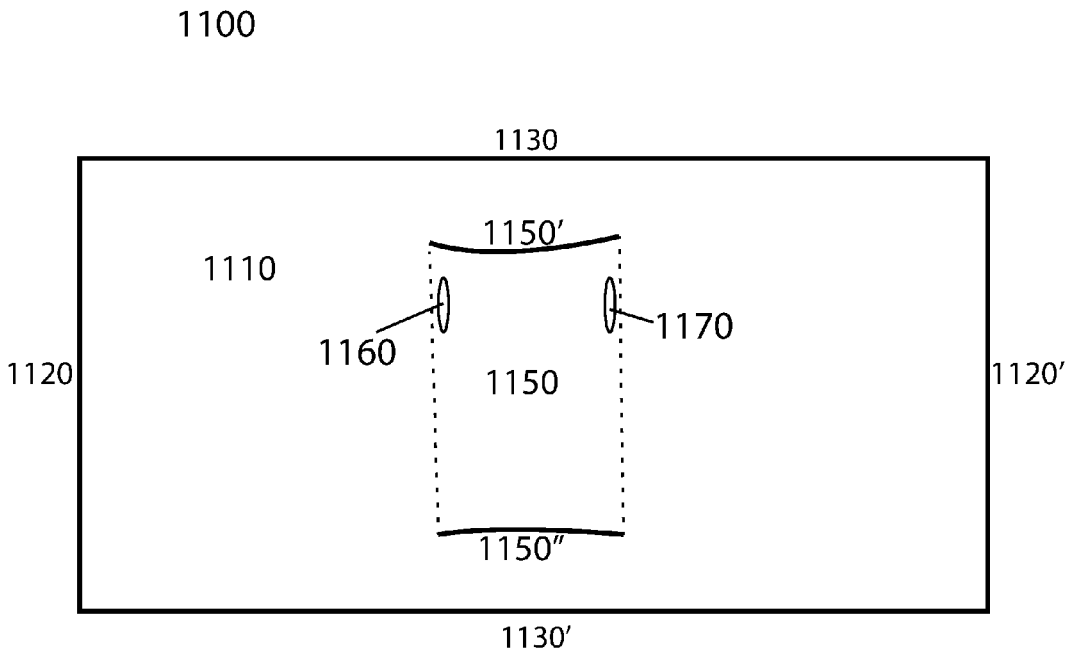
FIG. 11 shows an alternate embodiment of the present invention in a flattened configuration.

For example, referring to FIG. 10, an integrated garment 1000 is shown. Garment 1000 incorporates not only the shawl portion 1010 described above, but also a short portion 1020 that has been knit with the garment as a single unit. Referring to the plan view of FIG. 11, as with the prior embodiments, garment 1100 may comprise an elongate body portion 1110 formed from one or more pieces of material that is generally rectangular in shape defined by top and bottom vertical edge portions 1120, 1120' and top and bottom horizontal edge portions 1130 and 1130'. Arm openings 1160, 1170 may be formed in secondary portion 1150.

In embodiments, a secondary portion 1150 may be formed in the garment. In a preferred embodiment, secondary portion 1150 may be formed of the same material as body portion 1110 by tubular knit-in technique. Secondary portion 1150 may be attached laterally linked-on by linking machine or sewn-on by sewing machine on two sides leaving open a top neck portion 1150' and bottom torso portion 1150". Arm openings 1160, 1170 may be provided for receiving the wearer's arms.

In a preferred embodiment, the entire garment 1100 is formed from a tubular or seamless knitting technique and knit in a single manufacturing step, which can minimize labor and cost, and also provide for a more attractive product. Traditional commercial knitting processes have generally been found to be unsuitable for producing such a garment. However, advances in mechanized knitting technology have made production of the embodiments shown herein possible.

It has been found that machines such as the Shima Seiki Wholegarment Computerized Flat Knitting Machine (Mach2XS) and the Stoll Knit and Wear series of machines are well-suited for use with the present invention.

Figure 12:
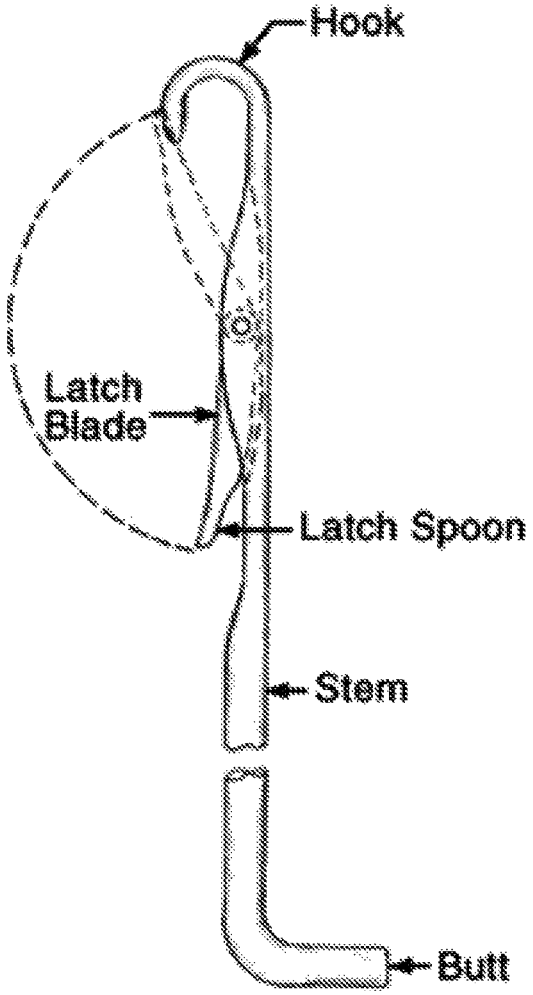
FIG. 12 shows an exemplary needle for use with embodiments of the invention.

Generally speaking, knitting involves interlacing yarn or thread in a series of connected loops, which are called stitches. Arrays of needles are organized into beds, which slide up or down to carry and transfer the yarn or thread. Needles may be curved or straight, and may contain a latch to hook the yarn. An exemplary latch needle is shown in FIG. 12.

Cams typically cause the needles in the bed to be raised and lowered. A carriage traverses the needle beds to raise and lower the needles according to the desired pattern. Successive loops in the fabric or garment are pulled through an existing loop and this process is repeated until completion.

As a needle is raised by a cam, the downward hook passes by the current yarn segment before hooking that yarn segment on the lowering movement. The latch of the needle catches the yarn and holds the yarn in place as another active yarn segment is passed across, pulling the yarn through the prior loop or stitch. The needle then releases the current loop or stitch on the raising movement. The current loops, known as "active loops," are held on a needle until another loop can be passed through them to complete the stitch.

In embodiments that utilize the whole garment machines capable of seamless knitting, specially configured machines these stitches can be passed from one bed to the other and the beds can be moved in relation to one another. This transfer ability permits the integration of components such as pockets and lateral sleeves into the garment as it is knit.

In embodiments, components of the garment (e.g., sleeves) may be formed separately (with the remainder of the garment may be formed from the tubular or seamless technique) and joined to the main garment using a linking technique.

Linking is a method of seaming/attaching pieces of a garment together after the pieces have been knitted on a flat-bed knitting machine. It will be appreciated by those of skill in the art that the linking process requires a skilled operator, and is used mainly for fully-fashioned knitted apparel. In the linking process, a slacker course of loops of yarn is created on the linking machine, which connects two pieces of fabric together.

It will be understood that there are numerous modifications of the illustrated embodiments described above which will be readily apparent to one skilled in the art, such as any other combinations of features disclosed herein that are individually disclosed or claimed herein, explicitly including additional combinations of such features. These modifications and/or combinations fall within the art to which this invention relates and are intended to be within the scope of the claims, which follow. It is noted, as is conventional, the use of a singular element in a claim is intended to cover one or more of such an element.

I claim:

1. A multipurpose garment comprising:

a body portion defined by a left vertical edge, a right vertical edge, a top horizontal edge and a bottom horizontal edge, the body portion including a first set of connecting loops;

a left sleeve section and a right sleeve section, the left sleeve section and the right sleeve section being substantially parallel to the top horizontal edge and the bottom horizontal edge, the left sleeve section and the right sleeve section including a second set of connecting loops;

wherein the second set of connecting loops of the left sleeve section and the right sleeve section are seamlessly integrated with the first set of connecting loops of the body portion by interlacing the first set of connecting loops to the second set of connecting loops.

2. The multipurpose garment of claim 1 wherein the first set of connecting loops are interlaced with the second set of connecting loops with a seamless knitting technique.

3. The multipurpose garment of claim 2 wherein the seamless knitting technique passes stitches from the first set of connecting loops to the second set of connecting loops using a multiple-bed knitting machine.

4. The multipurpose garment of claim 2 wherein the seamless knitting technique passes stitches from the first set of connecting loops to the second set of connecting loops using a flat knitting machine.

5. The multipurpose garment of claim 2 wherein the seamless knitting technique is a three-dimensional knitting process.

6. The multipurpose garment of claim 1 wherein the left sleeve section and the right sleeve section are open at each end.

7. The multipurpose garment of claim 1 further comprises:

a decorative texture.

8. The multipurpose garment of claim 1 wherein the multipurpose garment is formed from one of wool, cotton, linen, silk, rayon, nylon, polyester and blends thereof.

* * * * *